US009487980B2

(12) United States Patent
Pelekanos et al.

(10) Patent No.: US 9,487,980 B2
(45) Date of Patent: Nov. 8, 2016

(54) ADJUSTABLE HINGE

(71) Applicant: Schlage Lock Company LLC, Carmel, IN (US)

(72) Inventors: Stylianos Pelekanos, Regents Park (AU); Stephanie Winkler, Regents Park (AU)

(73) Assignee: Schlage Lock Company LLC, Carmel, IN (US)

( * ) Notice: Subject to any disclaimer, the term of this patent is extended or adjusted under 35 U.S.C. 154(b) by 0 days.

(21) Appl. No.: 14/782,262

(22) PCT Filed: Mar. 3, 2014

(86) PCT No.: PCT/AU2014/000192

§ 371 (c)(1),
(2) Date: Oct. 2, 2015

(87) PCT Pub. No.: WO2014/161024

PCT Pub. Date: Oct. 9, 2014

(65) Prior Publication Data

US 2016/0047151 A1 Feb. 18, 2016

(30) Foreign Application Priority Data

Apr. 4, 2013 (AU) ..... 2013202517

(51) Int. Cl.
*E05D 7/04* (2006.01)
*E05D 11/00* (2006.01)
(Continued)

(52) U.S. Cl.
CPC ..... *E05D 7/0423* (2013.01); *E05D 7/0045* (2013.01); *E05D 7/04* (2013.01);
(Continued)

(58) Field of Classification Search
CPC ..... Y10T 16/5321; Y10T 16/5322; Y10T 16/53225; Y10T 16/5323; Y10T 16/53235; Y10T 16/53253; Y10T 16/53257; Y10T 16/5327; Y10T 16/53247; E05D 7/04; E05D 7/0423; E05D 7/0415; E05D 7/043; E05D 7/0027; E05D 7/0045; E05D 2007/0438; E05D 2007/0046; E05D 2007/0453; E05D 2007/0461; E05D 2007/0476; E05D 2007/0484; E05D 2007/0492; E05D 2007/0036; E05D 2007/0469; E05Y 2900/20
See application file for complete search history.

(56) References Cited

U.S. PATENT DOCUMENTS 2,583,950 A * 1/1952 Kirschner ..... E05D 7/0423 16/238
2,839,778 A * 6/1958 Hutchinson ..... E05D 7/0423 16/245

(Continued)

FOREIGN PATENT DOCUMENTS

GB 2490124 A 10/2012
JP 10196196 A * 7/1998

(Continued)

OTHER PUBLICATIONS

WO 2014/161024, Written Opinion of the International Searching Authority, May 21, 2014.

(Continued)

*Primary Examiner* — Chuck Mah
(74) *Attorney, Agent, or Firm* — Kilpatrick Townsend & Stockton LLP

(57) ABSTRACT

A hinge with a main body and first and second connector parts for mounting the hinge to a respective one of a jamb or panel, the main body being formed of first and second aligned hinge components arranged to rotate relative to each other about a pivot axis, wherein the hinge further includes an adjustment mechanism carried by one of the components to adjust the relative position of the connector parts.

32 Claims, 7 Drawing Sheets

(51) Int. Cl.
*E05D 7/00* (2006.01)
*E05D 3/02* (2006.01)

(52) U.S. Cl.
CPC .... *E05D 11/0054* (2013.01); *E05D 2003/025* (2013.01); *E05D 2007/0469* (2013.01); *E05D 2007/0476* (2013.01); *E05D 2007/0484* (2013.01)

(56) References Cited

U.S. PATENT DOCUMENTS 5,339,493 A * 8/1994 MacIntyre ..... E05D 7/0423 16/237
5,694,665 A * 12/1997 Strickland ..... E05D 7/0423 16/237
5,755,011 A * 5/1998 Green ..... E05D 7/0027 16/238
5,799,370 A * 9/1998 Davidian ..... E05D 7/0415 16/236
6,715,181 B1 * 4/2004 Fries ..... E05D 7/0415 16/240
2001/0011406 A1 * 8/2001 Nakamoto ..... E05D 7/0027 16/271
2005/0193521 A1 * 9/2005 Heid ..... E05D 7/0027 16/271
2008/0022491 A1 * 1/2008 Campbell ..... E05D 7/0423 16/236
2008/0104798 A1 * 5/2008 Hoppe ..... E05D 7/0027 16/236
2008/0104799 A1 * 5/2008 Hoppe ..... E05D 7/0027 16/238
2008/0209679 A1 * 9/2008 Erickson ..... E05D 7/0423 16/245
2008/0263822 A1 * 10/2008 Sabrowski ..... E05D 7/0415 16/236
2008/0307606 A1 * 12/2008 Karlsson ..... E05D 7/0415 16/243
2010/0242227 A1 9/2010 Tagtow et al.
2013/0305448 A1 * 11/2013 Nguyen ..... A61H 33/06 4/533

FOREIGN PATENT DOCUMENTS

JP 10259681 A * 9/1998
JP 10331508 A * 12/1998
JP 2010275710 A * 12/2010

OTHER PUBLICATIONS

WO 2014/161024, Notification of Transmittal of the International Search Report and the Written Opinion of the International Searching Authority, or the Declaration, May 21, 2015.

* cited by examiner

ADJUSTABLE HINGE

RELATED APPLICATION

The present application claims priority from Australian Patent Application Number AU2013202517, the contents of which are incorporated by reference.

FIELD OF THE INVENTION

The present invention relates to an adjustable hinge particularly but not exclusively an adjustable architectural door hinge.

BACKGROUND OF THE INVENTION

Vertical and lateral adjustment of a door hinge to suit a position of a door panel can be achieved with a mechanism that is mortised or recessed in the door panel. The mechanism allows the position of a leaf of the hinge to be adjusted and then fixed relative to the door panel, which effectively adjusts the position of the hinge itself relative to the panel.

OBJECT OF THE INVENTION

The present invention seeks to provide an alternative mechanism for adjusting a hinge.

SUMMARY OF THE INVENTION

In accordance with the invention, there is provided hinge with a main body and first and second connector parts for mounting the hinge to a respective one of a jamb or panel, the main body being formed of first and second components arranged to rotate relative to each other about a pivot axis, the hinge further including an adjustment mechanism carried by one of the components to adjust the relative position of the connector parts, wherein:

the hinge components are fixed against relative axial movement and are coupled by a pivot connection that allows rotation of the components about the pivot axis;

the adjustment mechanism is housed within the first component, to adjust the position of the associated first connector part relative to the first component, independently of the pivot connection; and wherein the adjustment mechanism allows the position of the first connector part to be adjusted in a first direction, while allowing the connector part to float relative to the first component in a second direction, transverse to the first direction.

Preferably, the adjustment mechanism operates to move the first connector part relative to the first connector component, to displace the first connector component relative to the associated jamb or panel.

Preferably, the adjustment mechanism acts between a housing of the first connector component and an arm extension of the first connector part.

Preferably, the adjustment mechanism includes a device for transmitting rotary adjustment input to linear movement of the arm relative to the first component.

Preferably, the device includes a screw threaded shaft and a slide block threaded onto the shaft, the slide block engaging and driving the arm relative to the first component.

Preferably, the arm includes a slot to couple with the slide block.

Preferably, the slot has a lateral dimension to accommodate lateral play between the device and the arm.

Preferably, the adjustment mechanism is contained within a housing of the first component.

Preferably, the housing includes an aperture through which a tool is able to operate the adjustment mechanism.

Preferably, the aperture is positioned in a side wall of the housing and the mechanism is arranged to adjust the first component in a horizontal direction.

Preferably, the aperture is in an end of the housing and the mechanism is arranged to adjust the component in a vertical direction.

Preferably, the housing includes an elongate opening to receive the arm of the first connector part and accommodate movement of the arm relative to the first component.

Preferably, the parts form leaves of the hinge, wherein the second part is integrally connected to the second component and the first part is connected into the first component by the arm, which is moveably received through the aperture.

Preferably, the pivot connection is provided by a pivot pin that is rigidly fixed to the first component and projects into the second component.

Preferably, the hinge further includes a third connector part and associated third component mounted to a second end of the first component, the third component being supported on a second pivot pin that projects from the second end of the first component.

Preferably, the first component is configured to have substantially the same external visual appearance as a conventional hinge component.

In another aspect, there is provided an adjustable hinge set including multiple hinges, as described above, once hinge being configured to allow for horizontal adjustment and another hinge being configured for vertical adjustment.

Preferably, the adjustable hinge set includes a third hinge allowing for horizontal adjustment, the first and third hinges being arranged to mount a top and bottom of a panel to an adjacent jamb, while the second hinge is an intermediate hinge, located between the first and third hinges.

In another aspect, there is provided a folding panel assembly, including one or more panels and an adjustable hinge set, as described above, mounting one of the panels to an adjacent jamb.

In another aspect, there is provided a component for a hinge including a housing with an axially extending pivot pin projecting from one end of the housing, an elongate opening along a side of the housing, an internal recess for accommodating an adjustment mechanism and an aperture formed in a wall of the housing for operating the adjustment mechanism, wherein the elongate opening allows an extension arm of a connector part, used to attach the component to a jamb or panel, to extend into the recess for connection to the adjustment mechanism.

Preferably, the pivot pin is integrally formed with and fixed relative to the housing.

Preferably, the pivot pin projects outwardly from the end of the housing and does not extend through the recess whereby the adjustment mechanism adjusts the position of the connector part internally of the housing, free of direct connection to the pivot pin.

Preferably, the aperture is formed in a side wall of the housing, opposite the elongate opening.

Preferably, the aperture is formed in a second end wall of the housing.

Preferably, the aperture is formed in a side wall of the housing and a second aperture is provided in a second end wall of the housing.

Preferably, a second pivot pin projects from the second end wall, in an opposite direction to the first pivot pin.

Preferably, the first and second pivot pins are integrally formed with and fixed relative to the housing.

Preferably, the aperture in the second end wall communicates with an axial passage through the second pivot pin.

Preferably, the component further includes a cover plate that forms a side wall of the housing and restricts the opening to an elongate slot, for receipt of the arm.

Preferably, the component further includes the adjustment mechanism, to adjust the position of the connector part relative to the component, independently of the pivot pin.

Preferably, the adjustment mechanism allows the position of the connector part to be adjusted in a first direction, while allowing the connector part to float relative to the first component in a second direction, transverse to the first direction.

Preferably, the adjustment mechanism includes a device for transmitting rotary adjustment input to linear movement of the arm relative to the component.

Preferably, the device includes a screw threaded shaft and a slide block to engage and drive the arm relative to the component.

Preferably, the aperture is formed in a side wall of the housing, opposite the elongate opening, and the screw threaded shaft is adjustable through the aperture, to move the connector part in and out of the housing.

Preferably, the aperture is formed in a second end wall of the housing and the screw threaded shaft is adjustable though the aperture to drive the connector part up and down the housing.

Preferably, the component further includes a second pivot pin that projects from the second end wall, in an opposite direction to the first pivot pin, wherein the aperture in the second end wall communicates with an axial passage through the second pivot pin and the shaft extends through the passage and is operable via a remote end of the second pivot pin.

BRIEF DESCRIPTION OF THE DRAWINGS

The invention is described, by way on non-limiting example only, with reference to the accompanying drawings, in which.

DETAILED DESCRIPTION OF THE INVENTION

Figure 1:
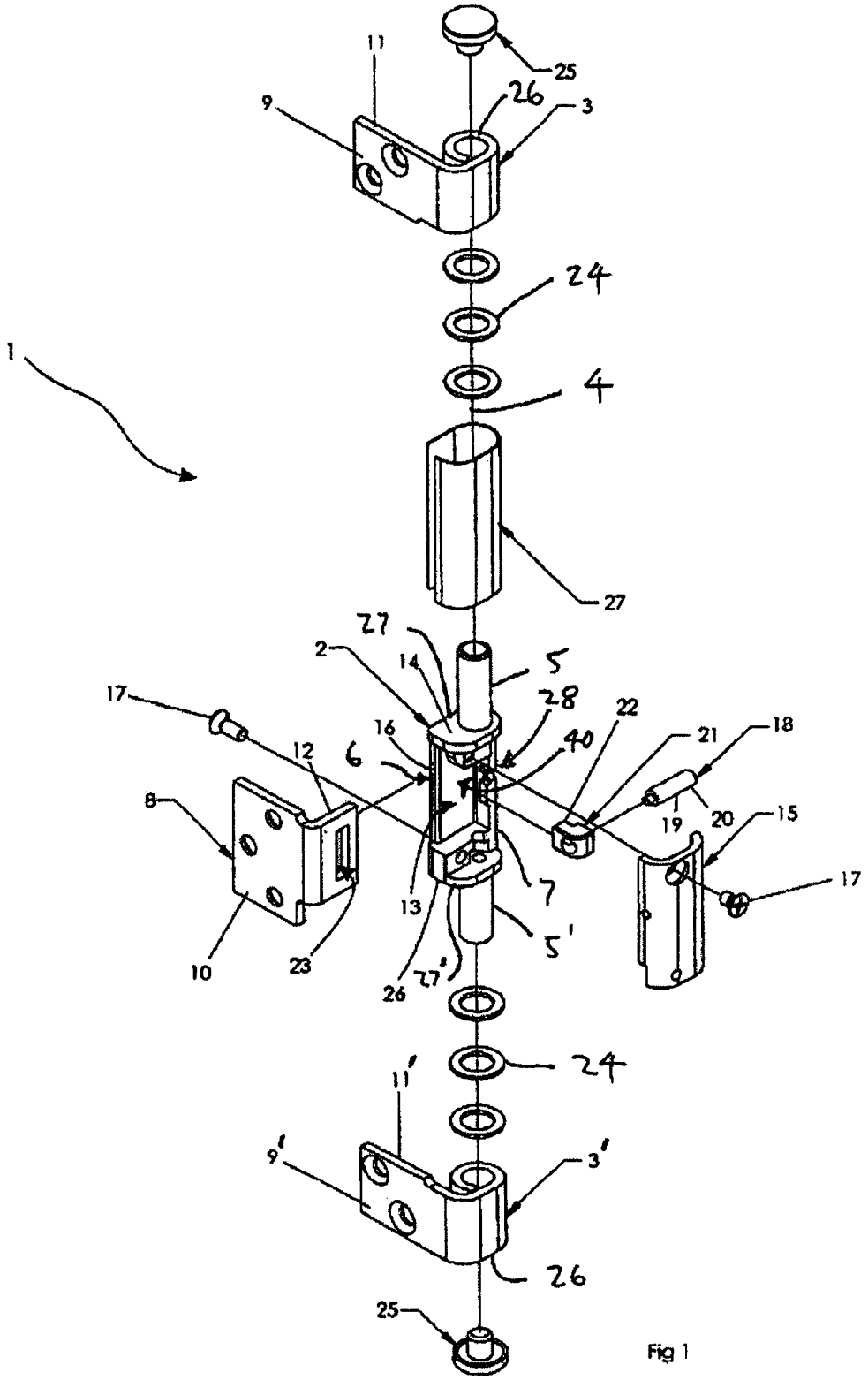
FIG. 1 is an exploded perspective view of a hinge.
Figure 2D:
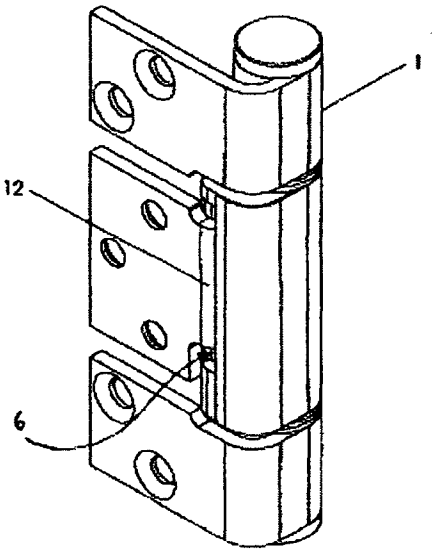
FIG. 2*d* is a perspective view of the hinge.
Figure 2C:
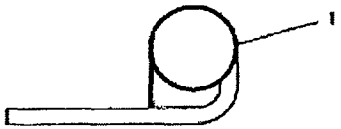
FIG. 2*c* is a plan view of the hinge.
Figure 2B:
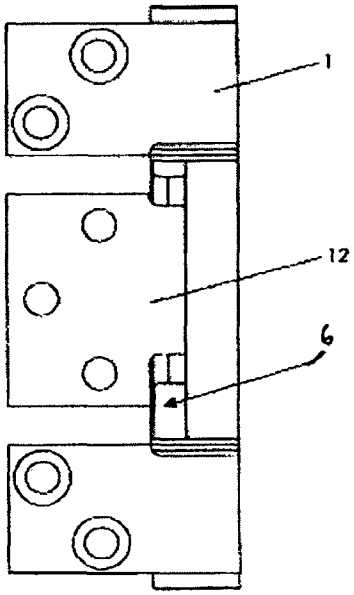
FIG. 2*b* is a front view of the hinge.
Figure 2A:
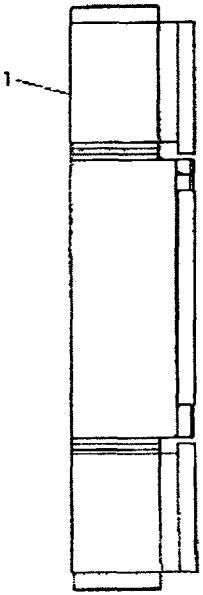
FIG. 2*a* is an end view of the hinge.

Referring firstly to FIG. 1, a hinge 1 is shown as including a first component 2 and an aligned second component 3 and third component 3', arranged to rotate about a common pivot axis 4 defined by a hinge pins 5, 5'.

The hinge pins 5, 5' are fixed to and formed integrally with the first component 2, so as to project from respective first and second ends 27, 27'. The hinge pins 5, 5' extend co-axially though the second and third components 3, 3' and thereby provide pivot connections between the first, second and third components 2, 3, 3'.

The hinge 1 also includes first, second and third connecting parts 8, 9, 9' forming hinge leaves 10, 11, 11'. The second and third connecting parts 9, 9' are integrally formed with the second and third component 3, 3'. The first part 8 is integrally formed with an angled extension arm 12 that is received in a elongate opening 13 of the first component 2.

The first component 2 includes a housing 14 formed of a cover 15 fixed to a side wall 16 by fasteners 17. When the cover is secured in place, the opening 13 is restricted to an elongate slot 6 to receive the arm 12.

The housing 14 accommodates an adjustment mechanism 18 in an internal recess 40. It should be noted the pivot pins 5, 5' do not pass through the recess 40 so there is no direct, connection between the mechanism 18 and the pivot pins 5, 5' and the mechanism operates independently of the pivot pins 5, 5' as a result.

The mechanism 18 is formed of a device 19 for transmitting rotary adjustment input into linear motion. For that purpose, the device 19 includes a threaded shaft 20 and an internally threaded slide block 21 designed to move lengthwise along the shaft 20 when the shaft 20 is rotated. The housing 14 includes an aperture 28 in a side wall 7 to provide access to the shaft 20.

The slide block 21 includes a tongue 22 that is received in a slot 23 of the arm 12 so that linear movement of the slide block 21 results in corresponding linear movement of the arm 12. The slot 23 has a lateral dimension to accommodate lateral/vertical play between the arm 12 and the slide block 21. As such, the adjustment mechanism 18 can move the arm 12 in and out of the opening 13 so that the first part 8 is displaced relative to the housing 14. This has the effect of laterally moving the first part 8 relative to the second and third parts 9, 9', providing relative horizontal adjustment between the parts 8 and 9, 9' whilst allowing for limited free or floating movement between the parts 8 and 9, 9' in a vertical direction.

The hinge 1 also includes washers 24 and a hinge cap o-ring and a hinge cap 25 to close off the remote ends 26 of the second and third components. A cover 27 may be provided as decorative trim that clips over the housing 14, so that the exterior of the component 2 has the same visual aesthetic as the conventional hinge and provides substantially the same finish as the second and third components 3, 3'.

Referring now to FIG. 2, the hinge 1 is shown in an assembled condition. As may be appreciated, the hinge 1 has a conventional appearance although the front and perspective views of FIGS. 2*b* and 2*d* show the elongate slot 6 through which the arm 12 moves in and out, for horizontal adjustment, and up and down to allow the first part 8 to float and establish a rest position relative to the second and third parts 9, 9'.

Figure 3B:
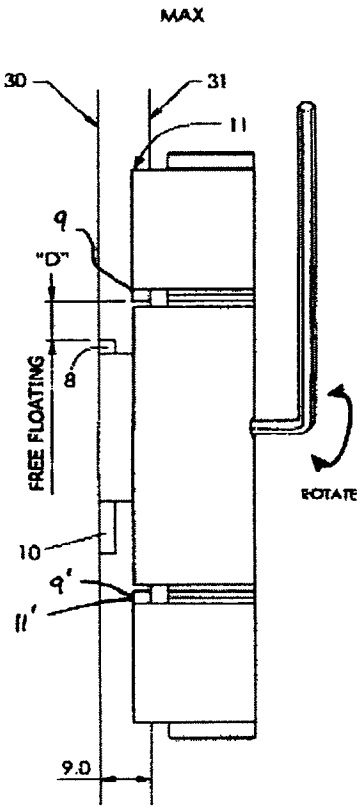
FIG. 3*b* is an end view of the hinge.
Figure 3C:
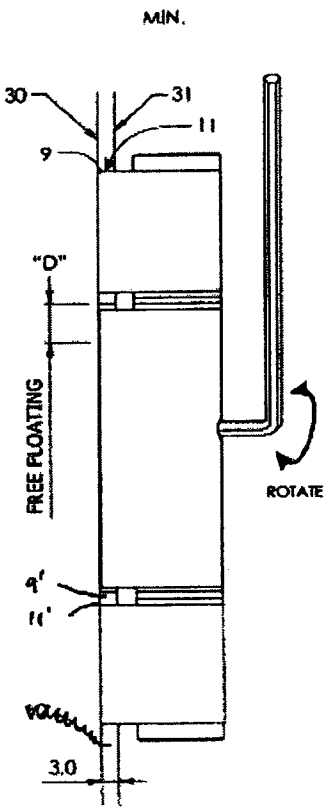
FIG. 3*c* illustrates a second component of the hinge displaced horizontally relative to a first component.
Figure 3A:
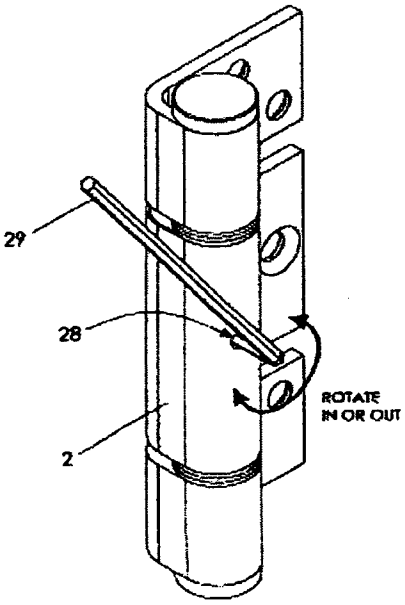
FIG. 3*a* is a rear perspective view of the hinge.

Referring to FIG. 3*a*, the aperture 28 can be clearly seen in the first component 2. The aperture 28 provides access for a tool 29 to engage the device 19 of the adjustment mechanism 18 and provide a rotational input to the shaft 20.

In FIG. 3*b*, the first component 8, in the form of hinge leaf 10, is face mounted to a jamb 30. The second and third components 9, 9', in the form of hinge leaves 11, 11', are edge mounted to a panel 31. The hinge leaves 10 and 11, 11' are shown in an offset condition, where the panel 31 is positioned close to the jamb, such as by a distance of 9 mm. The tool 29 can then be rotated so that the adjustment mechanism 18 drives the arm laterally to displace the hinge leaf 10 horizontally relative to the hinge leaves 11, 11', to the condition shown in FIG. 3*c*, where the hinge leaves 10 and 11, 11' are aligned and the panel 31 is located much closer to the jamb 30, such as in the order of 3 mm.

FIG. 3*b* also shows the leaf 10 in a slightly elevated position relative to that shown in FIG. 3*a*, such that a distance "D" between the two hinge leaves 10, 11 is reduced, as a result of the panel 31 and jamb 30 being slightly offset from an ideal position, that requires the first part to float higher in order to self-adjust in the vertical direction and maintain proper functioning of the hinge 1.

Figure 4:
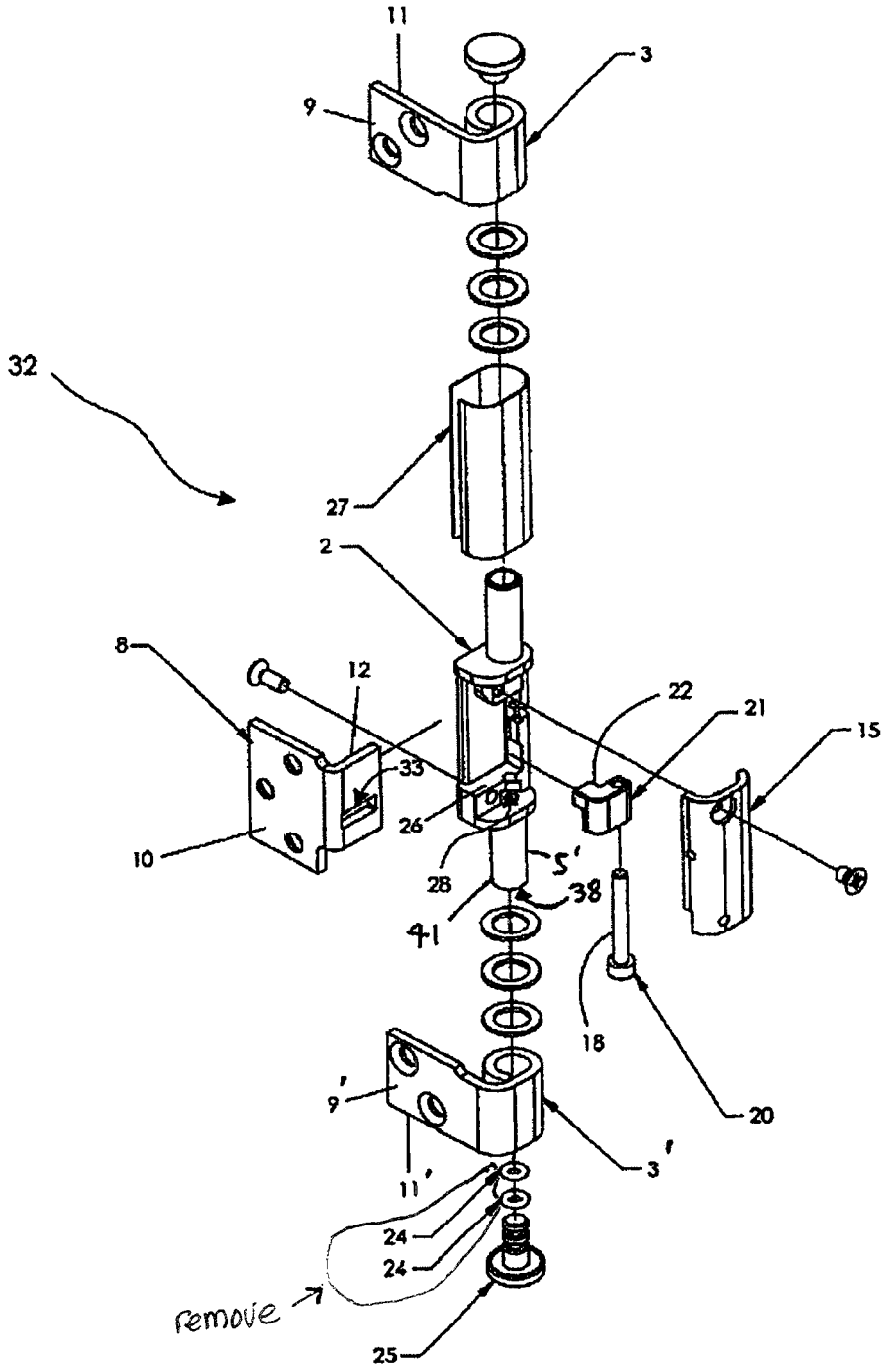
FIG. 4 is an exploded perspective view of a second hinge.
Figure 5D:
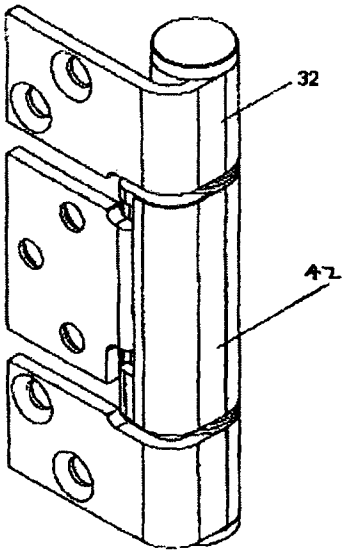
FIG. 5*d* is a perspective view of the second hinge.
Figure 5C:
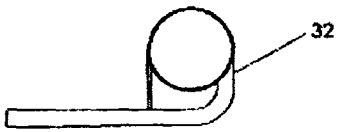
FIG. 5*c* is a plan view of the second hinge.
Figure 5B:
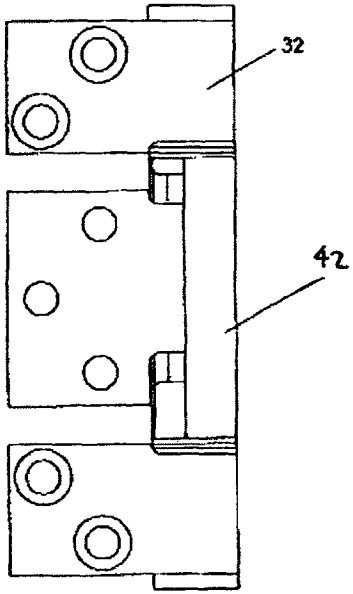
FIG. 5*b* is a front view of the second hinge.
Figure 5A:
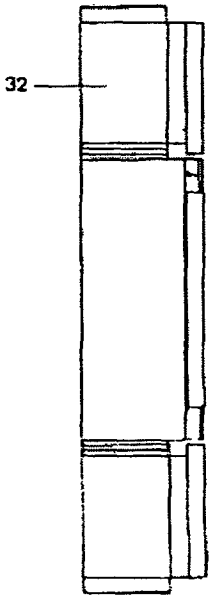
FIG. 5*a* is an end view of the second hinge.

Referring now to FIG. 4, a second hinge 32 is shown, to allow for vertical adjustment and horizontal floating. The hinge 32 is generally similar to the hinge 1 and like parts are denoted with like reference numerals.

The difference between the hinges 1 and 32 is the adjustment mechanism operates in a vertical direction. In particular, the shaft 20 is arranged vertically and the aperture 28 for accessing the shaft 20 is provided in a second end 26 of the first component 2. The shaft 20 is mounted in an axially extending passage 38 formed in the pivot pin 5' and is operable through a remote end 41 of the pivot pin 5'.

The arm 12 has a horizontally extending slot 33 to receive the tongue 22 of the slide block 21 so that linear movement of slide block 21 drives the arm in a vertical direction. The horizontal configuration of the slot 33 accommodates free lateral movement between the arm 12 and the adjustment mechanism 18, to allow the first connecting part 8 to "float" in a horizontal direction relative to the first component 2.

Referring to FIG. 5, the hinge 32 has an identical appearance to the hinge 1, even though the hinge allows for adjustment in the vertical direction, as opposed to horizontal adjustment. As with the hinge 1, a cover 42 provides an aesthetic similar to a conventional hinge.

Figure 6C:
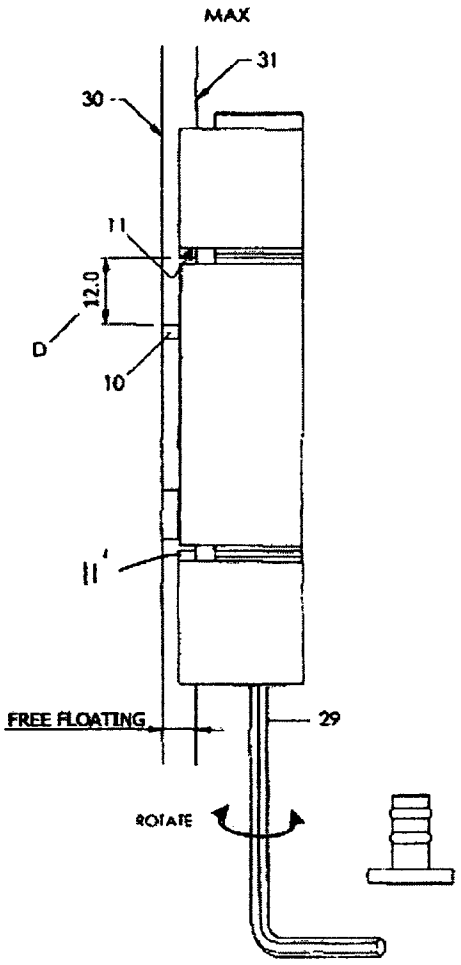
FIG. 6*c* illustrates a second component of the second hinge displaced vertically relative to a first component.
Figure 6B:
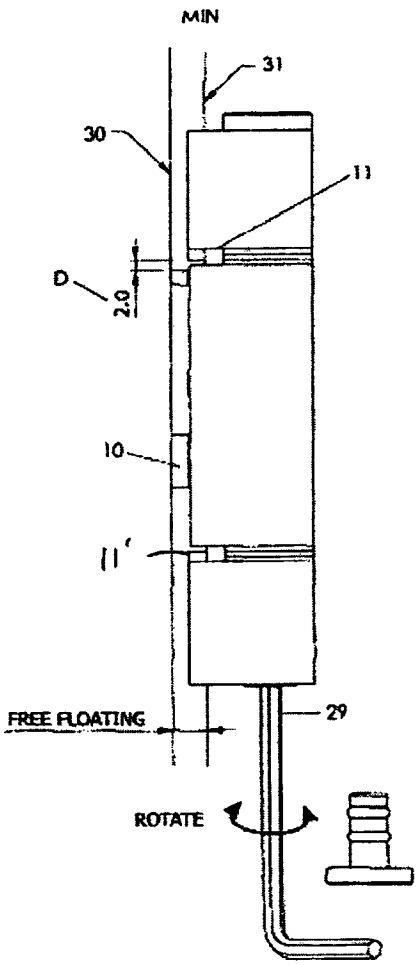
FIG. 6*b* is an end view of the second hinge.
Figure 6A:
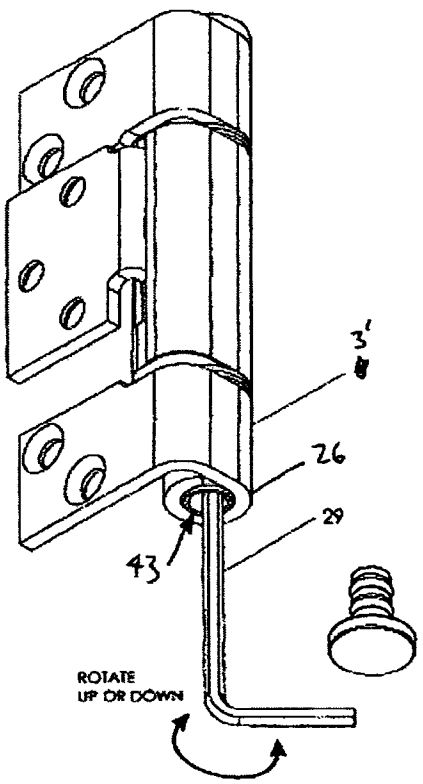
FIG. 6*a* is a rear perspective view of the second hinge.

Referring now to FIG. 6*a*, the tool 29 is shown inserted in an opening 43 in the end 26 of the third component 3', in order to access the adjustment mechanism, to rotate the shaft 20.

In FIG. 6*b*, the hinge leaf 10 is mounted to the jamb 30 and the hinge leaves 11, 11' is edge mounted to the panel 31. The distance "D" between the hinge leaves 10 and 11 is in the order of 2 mm. In order to adjust the distance between the hinge leaves 10 and 11, the tool 29 is rotated to drive the leaf 10 downwardly, which serves to increase the distance D by up to, for example, 12 mm, as shown in FIG. 6*c*. The hinge 32 also allows for the hinge leaf 10 float relative to the hinge leaves 11, 11', in order to accommodate any horizontal offset between the panel 31 and jamb 30.

Figure 7:
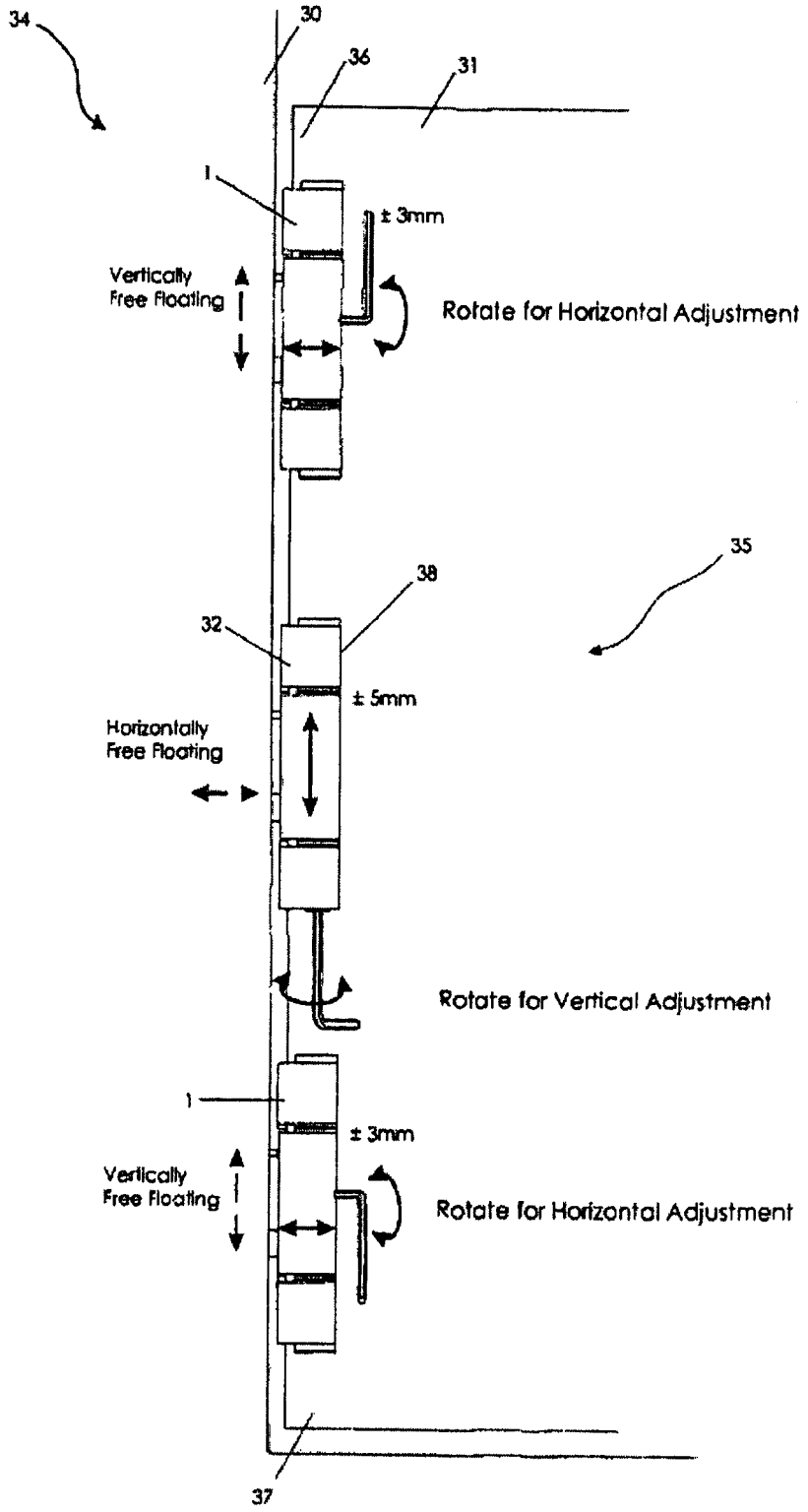
FIG. 7 is a diagrammatic representation of a folding panel system and adjustable hinge set.

Referring now to FIG. 7, a folding panel assembly 34 is shown with the panel 31 mounted to the jamb 30 with an adjustable hinge set 35. The panel assembly may include one or more panels (not shown), as required. More particularly, the panel 31 may be any one of a hinged door, single, bi-parting (French) or part of a multi panel folding door system.

The adjustable hinge set includes two hinges 1 positioned about 100 mm from a top 36 and a bottom 37 of the panel 31. The hinges 1 allow for horizontal adjustment and vertical floating between the panel 31 and jamb 30. A hinge 32 forms an intermediate hinge 38, positioned between the hinges 1, to provide vertical adjustment and horizontal floating.

To mount the panel 31 to the jamb 30 using conventional adjustment techniques would be extremely difficult for a single person to easily achieve. However, the adjustable hinge set 35 enables one person to readily adjust all of the hinges independently, with the hinges 1 providing horizontal adjustment, with vertical floating, while the hinge 32 provides horizontal adjustment and vertical floating. This configuration allows for the panel 31 to be hinged to the jamb 30 without any adverse forces between the panel 31 and jamb 30.

The height adjustment provided by the hinge 32 is preferably in the range of 10 mm and the horizontal adjustment is preferably in the order of 6 mm. However, these ranges may be less or more, as required. Many other modifications and variations can be made without departing from the spirit and scope of the invention described.

As may be appreciated, the invention provides a convenient mechanism for fine thread type adjustment of a panel and there is no need for the conventional morticing of the adjustment mechanism in the panel since the mechanism itself is carried within the hinge component 2. As such, the adjustable hinge of the invention can be face or edge mounted and used on a metallic jamb and door panel, such as made of aluminium, without the need for morticing, which would otherwise be difficult with an aluminium door.

It should also be appreciated the hinges 1, 32 may be provided with only first and second components 2, 3 and the third component 3' may be omitted, if required.

Lastly, the component 2 is preferably formed with apertures 28 in both the side wall 7 and second end wall 27' so that the housing 14 is universal and can be used for either vertical or horizontal adjustment, dependent only in the configuration of the adjustment mechanism 18 and shaft 20 inside the housing 14.

LIST OF PARTS

1. Hinge
2. First component
3. Second component
3'. Third component
4. Thrust bearing
5. Hinge pin
5'. Hinge pin
6. Slot
7. Side wall
8. First connecting part
9. Second connecting part
9'. Third connecting part
10. Hinge leaf
11. Hinge leaf
11'. Hinge leaf
12. Arm
13. Aperture
14. Housing
15. Cover
16. Side wall
17. Fasteners
18. Adjustment mechanism
19. Device
20. Threaded shaft
21. Slide block
22. Tongue
23. Slot
24. Washer
25. Hinge cap
26. End

27. First end
27'. Second end
28. Aperture
29. Tool
30. Jamb
31. Panel
32. Hinge
33. Slot
34. Folding panel assembly
35. Adjustable hinge set
36. Top
37. Bottom
38. Intermediate hinge
39. Passage
40. Recess
41. Remote end
42. Cover
43. Opening

The invention claimed is:

1. A hinge, comprising:

a main body comprising, first and second components arranged to rotate relative to each other about a pivot axis, wherein the first and second components are fixed against relative axial movement along the pivot axis and are coupled together by a pivot connection that allows rotation of the second component about the pivot axis;

first and second connecting parts for mounting the hinge to a jamb or panel; and an adjustment mechanism housed within the first component, wherein the adjustment mechanism couples to the first connecting part and adjusts the relative position of the first component with respect to the first connecting part in a first direction while the first and second components remain axially fixed and wherein the first connecting part floats relative to the first component in a second direction, transverse to the first direction.

2. The hinge of claim 1, wherein the adjustment mechanism operates to axially move the first connecting part relative to the first component in the first direction that extends along the pivot axis or parallel to the pivot axis.

3. The hinge of claim 1, wherein the adjustment mechanism acts between a housing of the first component and an arm extension of the first connecting part.

4. The hinge of claim 3, wherein the adjustment mechanism includes a device for transmitting rotary adjustment input to linear movement of the arm relative to the first component.

5. The hinge of claim 4, wherein the device comprises a threaded shaft and a slide block threaded onto the threaded shaft, the slide block engaging and driving the arm relative to the first component.

6. The hinge of claim 5, wherein the arm defines a slot configured to couple with the slide block.

7. The hinge of claim 6, wherein the slot has a lateral dimension to accommodate lateral play between the slide block and the arm.

8. The hinge of claim 7, wherein the adjustment mechanism is contained within the housing of the first component.

9. The hinge of claim 8, wherein the housing includes an aperture through which a tool is able to operate the adjustment mechanism.

10. The hinge of claim 9, wherein the aperture is positioned in an end wall of the housing and the adjustment mechanism is arranged to adjust the first component in the second direction.

11. The hinge of claim 9, wherein the aperture is in a side wall of the housing and the mechanism is arranged to adjust the component in the first direction.

12. The hinge of claim 11, wherein the housing defines a cavity that receives the arm of the first connecting part and accommodates movement of the arm relative to the first component.

13. The hinge of claim 12, wherein the first and second connecting parts form leaves of the hinge, wherein the second connecting part is integrally connected to the second component and the first connecting part is connected to the first component by the arm.

14. The hinge of claim 1, wherein the pivot connection is provided by a pivot pin that is rigidly fixed to the first component and projects into the second component.

15. The hinge of claim 14, wherein the pivot connection is at a first end of the first component and the hinge further comprises a third connecting part and associated third component mounted to a second end of the first component, the third component being supported on a second pivot pin that projects from the second end of the first component.

16. The hinge of claim 1, wherein the adjustment mechanism operates to move the first connecting part in and out of the first component.

17. A hinge component, comprising:

a housing comprising, an axially extending first pivot pin projecting from first end wall of the housing, the housing defining an internal cavity, an elongate opening along a side wall of the housing in communication with the internal cavity, and a first aperture in communication with the internal cavity; and an adjustment mechanism within the housing, wherein the adjustment mechanism is configured to adjust the position of the housing with respect to a connecting part, wherein the adjustment mechanism is in communication with the first aperture;

wherein the housing is configured to receive the adjustment mechanism within the cavity, and wherein the adjustment mechanism couples to a portion of the connecting part through the elongate opening within the cavity.

18. The component of claim 17, wherein the first pivot pin is integrally formed with and fixed relative to the housing.

19. The component of claim 17, wherein the first pivot pin projects outwardly from the first end wall of the housing and does not extend through the cavity whereby the adjustment mechanism adjusts the position of the connecting part within the housing.

20. The component of claim 17, wherein the first aperture is formed in a side wall of the housing, opposite the elongate opening.

21. The component of claim 17, wherein the first aperture is formed in a second end wall of the housing.

22. The component of claim 21, wherein a second pivot pin projects from the second end wall, in a direction opposite the first pivot pin.

23. The component of claim 22, wherein the first and second pivot pins are integrally formed with and fixed relative to the housing.

24. The component of claim 22, wherein the first aperture in the second end wall communicates with an axial passage through the second pivot pin.

25. The component of claim 17, wherein a side wall defines the first aperture of the housing, and a second end wall defines a second aperture of the housing.

26. The component of claim 17, further comprising a cover plate that forms the side wall with the elongate slot.

27. The component of claim 26, comprising the connecting part coupled to the adjustment mechanism within the housing, wherein the adjustment mechanism adjusts the position of the housing relative to the connecting part.

28. The component of claim 27, wherein the adjustment mechanism includes a device for transmitting rotary adjustment input to linear movement of the housing.

29. The component of claim 28, wherein the device includes a screw threaded shaft and a slide block, wherein the slide block couples to the first connecting part.

30. The component of claim 29, wherein the first aperture is formed in the side wall of the housing, opposite the elongate opening, and the screw threaded shaft is adjustable through the first aperture, to move the first connecting part in and out of the housing.

31. The component of claim 29, wherein the first aperture is formed in a second end wall of the housing and the screw threaded shaft is adjustable though the first aperture to drive the first connecting part axially within the housing.

32. The component of claim 29, further including a second pivot pin that projects from a second end wall, in a direction opposite the first pivot pin, wherein the first aperture in the second end wall communicates with an axial passage through the second pivot pin and the shaft extends through the passage and is operable through an end of the second pivot pin.

* * * * *